US005182164A

United States Patent [19]

Eklund et al.

[11] Patent Number: 5,182,164

[45] Date of Patent: Jan. 26, 1993

[54] WET PRESS FELT TO BE USED IN PAPERMAKING MACHINE

[75] Inventors: Nils O. Eklund, East Greenwich, R.I.; Johan L. Olsson; Lars-Magnus Ström, both of Halmstad, Sweden

[73] Assignee: Nordiskafilt AB, Halmstad, Sweden

[21] Appl. No.: 357,430

[22] Filed: May 25, 1989

[30] Foreign Application Priority Data

Jun. 9, 1988 [SE] Sweden ..... 8802153
Jun. 9, 1988 [SE] Sweden ..... 8802154

[51] Int. Cl.[5] ..... B32B 5/02

[52] U.S. Cl. ..... 428/234; 139/383 A; 428/131; 428/137; 428/234; 428/238; 428/246; 428/280; 428/282; 428/284; 428/298; 428/300; 428/304.4; 428/913

[58] Field of Search ..... 428/137, 138, 246, 280, 428/281, 282, 283, 284, 298, 913, 300, 304.4, 234, 238, 239; 139/383 A

[56] References Cited

U.S. PATENT DOCUMENTS

| | | | |
|---|---|---|---|
| 4,446,187 | 5/1984 | Eklund | 428/234 |
| 4,701,368 | 10/1987 | Kiuchi et al. | 428/246 |
| 4,830,905 | 5/1989 | Gulya et al. | 428/282 |
| 4,851,281 | 7/1989 | Wood | 428/234 |
| 4,988,409 | 1/1991 | Nyberg | 162/358 |

*Primary Examiner*—James J. Bell
*Attorney, Agent, or Firm*—Kane, Dalsimer, Sullivan, Kurucz, Levy, Eisele and Richard

[57] ABSTRACT

A dewatering wet press felt to be used on papermaking machines and comprising at least one top layer made from staple fibers and the like and facing the paper web (4), and a second layer. The second layer constitutes a barrier layer of such a nature that during the compression phase in the press nip in the press section of the papermaking machine the water is forced through the second layer, but is prevented from flowing back to the top layer and the paper web during the expansion phase after the press nip.

12 Claims, 2 Drawing Sheets

WET PRESS FELT TO BE USED IN PAPERMAKING MACHINE

BACKGROUND OF THE INVENTION

1. Field of the invention

The subject invention concerns a dewatering felt to be used as a wet press felt in the press section of a papermaking machine.

2. Brief Description of the Prior Art

A papermaking machine comprises three different sections. In the forming section the stock suspension fed onto traveling forming fabric or between two such fabrics. The majority of the water is removed from the stock, so that a continuous paper sheet is formed on the fabric. The formed sheet is carried into the press section, where some more water is removed by pressing. Finally, the sheet is dried in the dryer section by being pressed against hot cylinders, so that the moisture in the paper sheet is vaporized.

An important part of the papermaking process is dewatering efficiency in the press section. It is much more economical to remove the water in the press section than to vaporize it in the dryer section. The energy consumption is considerably higher in the dryer section than in the press section.

In the press section of the papermaking machine the formed sheet is pressed to a higher dry content through repeated pressings, usually in roll press nips. The sheet is carried throgh the press nip together with one or several endless textile fabrics, that are generally referred to as press felts or wet felts.

The press felt usually comprises a soft surface layer closest to the paper web, which said surface layer is compressed to a rigidity without any air volume. Under the surface layer is usually arranged a base fabric, which is designed to retain most of its void volume, even when a maximum pressure is applied on the press felt.

The purpose of this design is that this part of the felt is supposed to absorb an optimal amount of water from the paper web at the compression of the web and the felt in the press nip and after this retain as much as possible of removed water, that later is released in a suitable manner, before the felt is reentered into the press nip.

In a nowadays common type of roller press the bottom press roller is formed with cavities in the form of suction holes, on the inside connected to a vacuum source, or lengthwise extending grooves (known as Venta or grooved roll) or blind drilled holes. The cavities in such a roll completely or partly replace the base part of the felt or supplement this as a water-absorbing medium, when the paper sheet and felt are compressed in the press nip. Normally, grooved and blind-drilled press rolls are used at the end of the press section at high linear pressures and high speeds.

When the paper sheet together with one or several press felts is carried into the press nip, the water from the fiber web is forced into the felt and then together with the amount of air stored in the surface layer of the felt it is forced backwards into the void volume of the base fabric and/or into the void volume of the press roll. Some water is also allowed to flow forwards or backwards in the lengthwise direction inside the felt. The relationship between these flow directions depends e.g. on the speed of the machine and on the design of the felt and its ability to handle the water removed from the sheet.

Several theories have been put forward about what is going on in the paper sheet and felt during the press process itself. The exerted nip pressure is the same for both paper sheet and felt, while on the other hand the hydrodynamic pressure is considerably higher in the sheet than in the felt. This pressure difference provides the driving force for the transportation of the water from the sheet to the felt.

The minimum thickness of the sheet and that felt probably appear at the same time and somewhat after mid nip. The sheet is considered to reach its maximum dry content at the very same moment. After that, the expansion is beginning in the sheet as well as in the felt. During this expansion a vacuum is created in the paper sheet and in the surface layer of the felt, both of which have been totally compressed during the maximum pressure. Available water is flowing back from the inside and base layers of the felt to the surface layer of the felt and further into the sheet to re-establish the pressure balance. This phase provides the driving force of the re-wetting inside the press nip.

In the prior-art felt constructions it is common practice to form the felt with a considerably denser surface layer facing the paper web than the backside structure and it has not been unusual to use lengthwise extending fibers on the web facing side. The high capillary forces together with the largest vacuum of the felt structure during the expansion phase have been absorbing water from an open backside structure toward the surface layer, whereby the vacuum rapidly decreases in the surface layer. When the vacuum of the sheet thus rises considerably and the flow resistance in the contact face of felt against the sheet decreases this results in high re-wetting and low paper dry content.

The purpose of this invention is to create and above all to maintain a vacuum pressure which is as high as possible in the surface layer of the felt during the expansion phase by counter-acting the water-flow from the interior of the felt to the side facing the paper web.

SUMMARY OF THE INVENTION

The invention comprises a dewatering felt which comprises:

at least a first and a second layer;

said first layer made up of staple fibers or interwoven yarns, which in position of use of the felt faces and abuts the material to be dewatered;

said second layer forms a barrier layer after the running-in of the felt, when the dewatering process has reached its continuous state;

said barrier layer having, relatively to the first layer, a high flow resistance in its thickness direction;

said flow resistance being such that the water and the air that have been forced through said second layer during the compression of the fiber web and the felt, due to the pressure of the roll press, are prevented from flowing back through said second layer to any significant extend, when vacuum is created during the expansion of the felt after the press nip.

In certain embodiments of the invention the second layer—the barrier layer—is a close structure with high capillary forces. During the compression phase of the felt in operation the relatively high roll press pressure is able to force water and air from the sheet and the surface structure of the felt through said second layer.

In the expansion phase the high vacuum in the second layer draws water from the interjacent base fabric and binds the water, while the considerably lower vacuum in the surface structure of the felt is not capable of returning water and air through the second-barrier-layer towards the surface layer, thus effectively sealing the felt surface structure and the paper sheet. Especially when a so called Venta-press nip or the like is used, the second layer preferably forms the bottom layer of the felt facing the lower press roll.

While the flow resistance in the "barrier layer" is high in the thickness direction, flow resistance in the direction of travel of the layer could be an advantage, as it allows water to flow easily in this direction.

In accordance with a first embodiment the "barrier layer" consists of a fibrous batt, the fibers of which mainly extend in the travel direction of the felt. These "stacked fibers" effectively restrict the water flow in the thickness direction of the layer, but the water can flow relatively freely in the channels between the fibers in the lengthwise direction of the fibers.

In accordance with a second embodiment the "barrier layer" consists of fine filament threads, extending in the lengthwise direction of the felt. These fine filament threads with a diameter preferably less than 0.14 mm, could be interconnected into bunches of filaments with no or a relatively low twist. The filament threads could be part of a lower layer in a multi layer base fabric.

In laminated felts with two or more base fabrics, the fine filament threads could be included as lengthwise extending strands in the bottom base fabric. In this embodiment, just as in the first embodiment the lengthwise extension of the filaments or of the fibers, respectively, provides an effective barrier against air and water-flow in the thickness direction of the layer, while the flow resistance is low along the fibers. Due to the densely stacked filaments or fibers, respectively, the capillary forces become high in the thickness direction which partly contributes both to the absorption of water and to the retainment of the absorbed water as an effective barrier against water- and air-flow, e.g. from a grooved lower press roll.

In accordance with a third embodiment of the invention the "barrier layer" consists of a perforated film with numerous, minute holes or it could be constituted by polymeric particles, which are sintered into a porous, film-resembling layer. The fine channels in the film contribute to a high flow resistance which allows the water to be let through at the highest pressure during the compression phase but effectively blocks the water-flow at a considerably lower vacuum during the expansion phase.

In accordance with a further embodiment the barrier layer could consist of polymeric foam, that also blocks the water-flow that is caused by the vacuum during the expansion phase.

In accordance with a further embodiment the "barrier layer" consists of an extremely hydrophilic, synthetic polymeric material with a high ability to retain water. The hydrophilic material could be either in the form of fibers or in the form of filaments, and it could be combined with the described first and second embodiments. The hydrophilic material could also be in the form of bonded fibrous material, a sintered polymeric powder, a permeable resin coating or in the form of a foam. Conventional hydrophilic materials are usable, but their effect could be reinforced by means of so called superabsorbent materials. In accordance with this embodiment the hydrophilic material absorbs water and effectively blocks water flow from the bottom face of the felt.

The dewatering felt can in its simplest version comprise a first layer—the surface layer—and a second layer—the barrier layer—which is situated underneath the surface layer. As a rule, it further comprises at least one base fabric just like prior art felts. The "barrier layer" could be a part of this base fabric, but it could also be a completely separate layer, which is needled to or in any other way is interconnected with the base fabric. Further batt layers in addition to said layers could also be included in the dewatering felt.

DESCRIPTION OF THE PREFERRED EMBODIMENT

Figure 1:
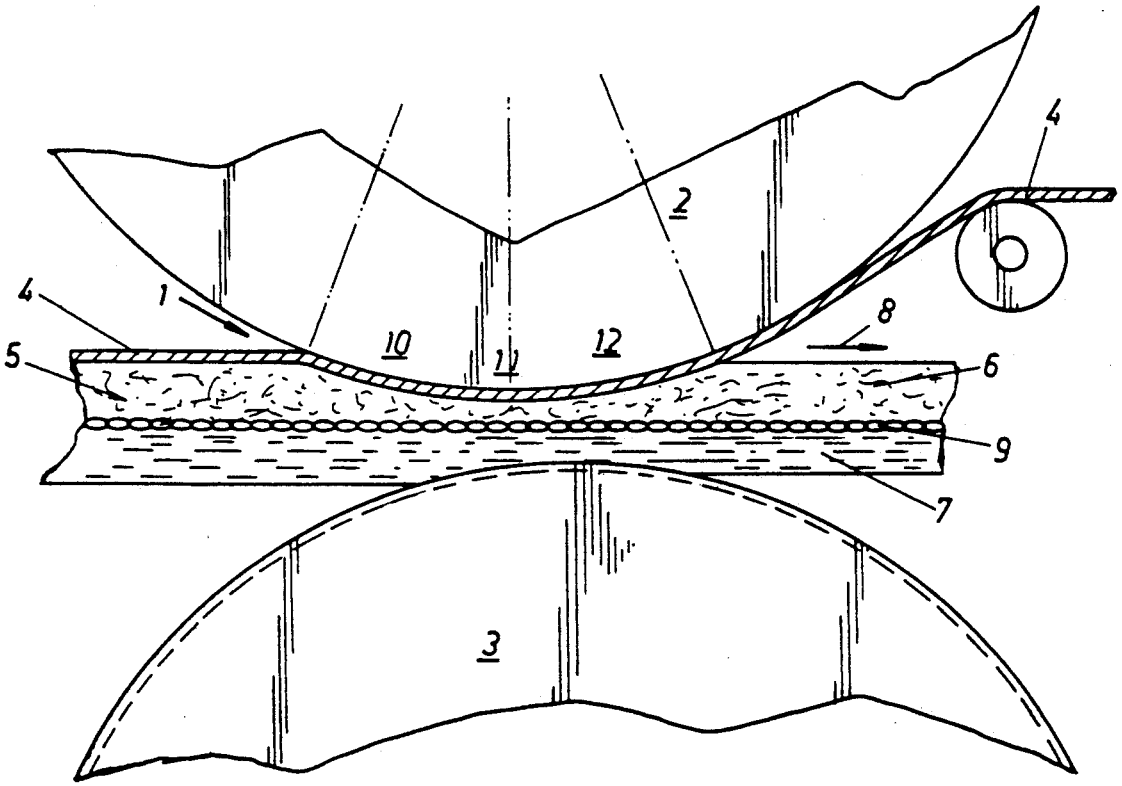
FIG. 1 is a press nip with a felt, equipped with a "barrier layer" of lengthwise extending fibers in accordance with the first embodiment
Figure 2:
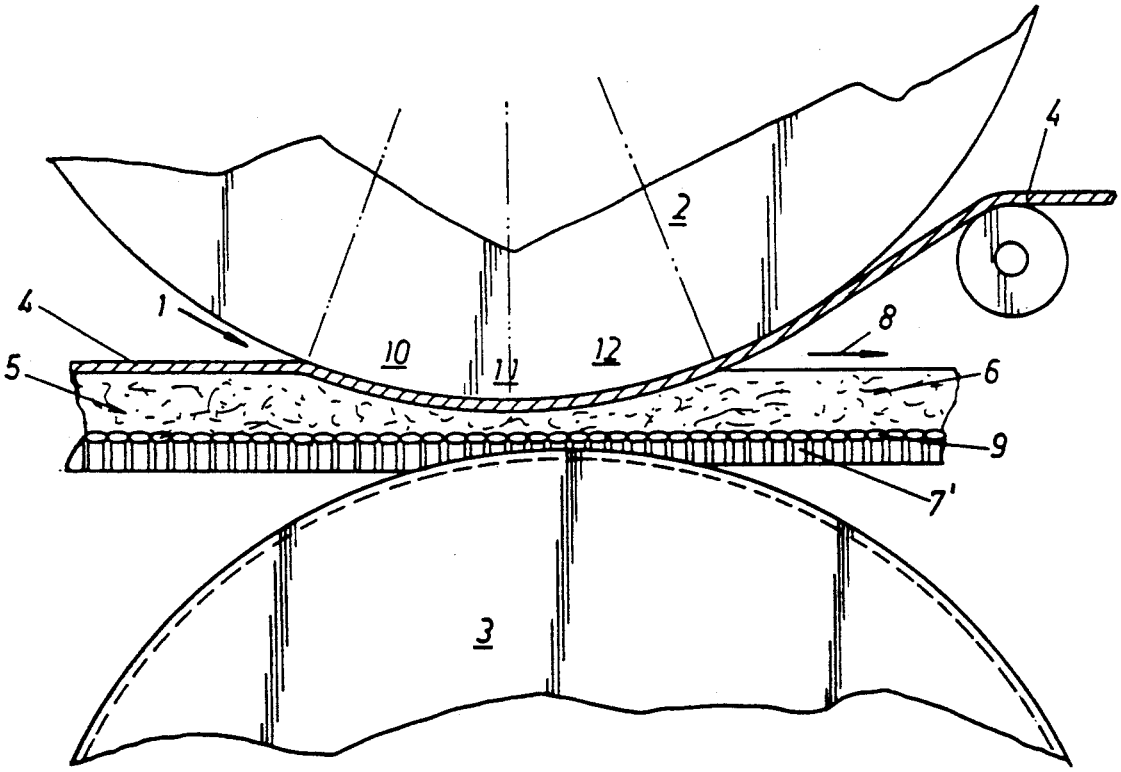
FIG. 2 is a felt equipped with a "barrier layer" of perforated film with numerous, minute holes.

The press nip 1 comprises a top press roll 2 and a bottom press roll 3. The bottom press roll 3 is preferably formed with cavities in the form of suction holes with vacuum, lengthwise extending grooves (so called Venta or grooved roll press) or blind-drilled holes. A paper web 4 and a felt 5 are carried through the press nip 1. The felt 5 comprises a first layer 6 (surface layer) of a non woven batt, positioned in immediate contact with the paper web 4. On the opposite side of the felt 5 is arranged a second layer 7 (barrier layer) consisting of a non woven batt the fibers of which extend mainly in the travelling direction 8 of the felt. In another embodiment the "barrier layer" consists of a perforated film 7' with numerous, minute holes. Between the two layers 6, 7 is further arranged a single-layer or double-layer base fabric 9.

The function of the press nip can be divided into two phases. During the first phase 10 the paper web as well as the felt are compressed due to the pressure produced between the press rolls. In this compression phase 10 the paper web 4 and the first layer (the surface layer) 6 are compressed to near absolute rigidity, i.e. the majority of the void volume and its contents of water and air disappear from these parts. Also the second layer (barrier layer) 7, irrespective of embodiment, can be heavily compressed during the compression phase 10, while the generally somewhat more incompressible base fabric 9 maintains some of its void volume. Water and air are partly forced from the web 4 and the surface layer 6, down into the limited void volume of the base fabric 9, and partly further through the "barrier layer" 7 down into the cavities in the bottom press roll 3. Water and air can pass through the "barrier layer" 7 due to the high pressure that is applied in the press nip 1 between the press rolls 2, 3. When the paper web 4 and the felt 5 have been compressed to a maximum, somewhat after the mid point 11 of the press nip 1, the paper web 4 is considered to have reached its maximum dry content. Then the second phase, the expansion phase 12 starts. The paper web 4 and the felt 5 expand without admission of air, and a vacuum is created in different parts of the felt. The highest vacuum is created in the batt layer 6 which has been totally compressed during the phase of maximum pressure. To re-establish the balance, available water flows into the parts with the highest vacuum.

In the first embodiment according to FIG. 1 a high vacuum is created in the "barrier layer" at the same time as the layer has a high capillary force in the thickness direction due to the lengthwise extending fibers. The "barrier layer" 7 absorbs water from the base fabric 9 and the cavities in the bottom press roll 3. This water can then flow in the lengthwise direction of the layer due to the low flow resistance that is present in this direction. The vacuum in the surface layer 6 is maintained to a significant degree because the "barrier layer" 7, owing to its high flow resistance in the thickness direction, its water content and the prevailing high capillary force, effectively prevents water from passing through from the rear face of the layer 7 and into the surface layer 6 due to the vacuum that is created therein. Consequently, the paper web 4 cannot either be rewetted to any noticeable extent and as a result, a paper sheet is obtained having higher dry contents than would otherwise have been possible.

The described embodiments of the invention are to be considered as example only, and a number of modifications are possible. The "barrier layer" can be made in different forms in accordance with the embodiments as is mentioned in the claims. The "barrier layer" could also be arranged in another position in the thickness of the felt, however always underneath the surface layer.

What is claimed is:

1. A dewatering felt to be used as a press felt in the press section of a papermaking machine, to dewater fibrous material, which comprises a plurality of layers including:

a base fabric of interwoven lengthwise and crosswise yarns, said lengthwise yarns being in the direction of travel of said felt on said papermaking machine, said base fabric having a first surface and a second surface;

a first layer on said first surface of said base fabric, said first layer being a non-woven batt of staple fibers needled to said base fabric, said first layer further being a surface layer facing and abutting said material to be dewatered; and a second layer, said second layer being a barrier layer beneath said surface layer and having a higher flow resistance in the thickness direction than said first layer, said second layer being a non-woven batt of staple fibers, needled to said base fabric, wherein said staple fibers of said second layer are predominantly oriented in said direction of travel of said felt, and wherein said second layer is needled to said second surface of said base fabric.

2. A dewatering felt as claimed in claim 1 wherein said staple fibers of said second layer are hydrophilic.

3. A dewatering felt to be used as a press felt in the press section of a papermaking machine, to dewater fibrous material, which comprises a plurality of layers including:

a base fabric of interwoven lengthwise and crosswise yarns, said lengthwise yarns being in the direction of travel of said felt on said papermaking machine, said base fabric having a first surface and a second surface;

a first layer on said first surface of said base fabric, said first layer being a non-woven batt of staple fibers needled to said base fabric, said first layer further being a surface layer facing and abutting said material to be dewatered; and a second layer, said second layer being a barrier layer beneath said surface layer and having a higher flow resistance in the thickness direction than said first layer, said second layer including essentially untwisted bunches of fine filament threads oriented in said direction of travel of said felt and further being connected to said base fabric, and wherein said second layer is connected to said second surface of said base fabric.

4. A dewatering felt as claimed in claim 3 wherein said fine filament threads of said second layer are hydrophilic.

5. A dewatering felt as claimed in claim 3 wherein said base fabric includes said second layer of fine filament threads.

6. A dewatering felt to be used as a press felt in the press section of a papermaking machine, to dewater fibrous material, which comprises a plurality of layers including:

a base fabric of interwoven lengthwise and crosswise yarns, said lengthwise yarns being in the direction of travel of said felt on said papermaking machine, said base fabric having a first surface and a second surface;

a first layer on said first surface of said base fabric, said first layer being a non-woven batt of staple fibers needled to said base fabric, said first layer further being a surface layer facing and abutting said material to be dewatered; and a second layer, said second layer being a barrier layer beneath said surface layer and having a higher flow resistance in the thickness direction than said first layer, said second layer including a foraminous, polymeric sheet with a plurality of channels therethrough for the passage of water from said fibrous material and further being connected to said base fabric, and wherein said second layer is attached to said second surface of said base fabric.

7. A dewatering felt as claimed in claim 6 wherein said foraminous, polymeric sheet is hydrophilic.

8. A dewatering felt to be used as a press felt in the press section of a papermaking machine, to dewater fibrous material, which comprises a plurality of layers including:

a base fabric of interwoven lengthwise and crosswise yarns, said lengthwise yarns being in the direction of travel of said felt on said papermaking machine, said base fabric having a first surface and a second surface;

a first layer on said first surface of said base fabric, said first layer being a non-woven batt of staple fibers needled to said base fabric, said first layer further being a surface layer facing and abutting said material to be dewatered; and a second layer, said second layer being a barrier layer beneath said surface layer and having a higher flow resistance in the thickness direction than said first layer, said second layer including a permeable, polymeric foam and further being connected to said base fabric, and wherein said second layer is attached to said second surface of said base fabric.

9. A dewatering felt as claimed in claim 8 wherein said permeable, polymeric foam is hydrophilic.

10. A dewatering felt to be used as a press felt in the press section of a papermaking machine, to dewater fibrous material, which comprises a plurality of layers including:

a base fabric of interwoven lengthwise and crosswise yarns, said lengthwise yarns being in the direction of travel of said felt on said papermaking machine, said base fabric having a first surface and a second surface;

a first layer on said first surface of said base fabric, said first layer being a non-woven batt of staple fibers needled to said base fabric, said first layer further being a surface layer facing and abutting said material to be dewatered; and a second layer, said second layer being a barrier layer beneath said surface layer and having a higher flow resistance in the thickness direction than said first layer, said second layer including an extremely hydrophilic, synthetic material with a high ability to retain water and further being connected to said base fabric, and wherein said second layer is attached to said second surface of said base fabric.

11. A dewatering felt to be used as a press felt in the press section of a papermaking machine, to dewater fibrous material, which comprises a plurality of layers including:

a base fabric of interwoven lengthwise and crosswise yarns, said lengthwise yarns being in the direction of travel of said felt on said papermaking machine, said base fabric having a first surface and a second surface;

a first layer on said first surface of said base fabric, said first layer being a non-woven batt of staple fibers needled to said base fabric, said first layer further being a surface layer facing and abutting said material to be dewatered; and a second layer, said second layer being a barrier layer beneath said surface layer and having a higher flow resistance in the thickness direction than said first layer, said second layer including essentially untwisted bunches of fine filament threads oriented in said direction of travel of said felt and further being connected to said base fabric, and wherein said second layer is within said base fabric.

12. A dewatering felt as claimed in claim 11 wherein said fine filament threads of said second layer are hydrophilic.

* * * * *